United States Patent [19]

Farnham

[11] Patent Number: 4,606,539

[45] Date of Patent: Aug. 19, 1986

[54] PHYSICAL THERAPY DEVICE

[76] Inventor: Richard D. Farnham, 48 Garrett Rd., Ithaca, N.Y. 14850

[21] Appl. No.: 558,482

[22] Filed: Dec. 6, 1983

[51] Int. Cl.[4] ..... A63B 21/00

[52] U.S. Cl. ..... 272/93; 272/145; 272/900

[58] Field of Search ..... 272/135, 136, 137, 144, 272/139, 900, 140, 126, 127, 62, 63, 138, 145, 120, 121, 125, 93; 128/25 R, 57, 24 R, 24.2, 24.3, 134; D24/36

[56] References Cited

U.S. PATENT DOCUMENTS

| | | | |
|---|---|---|---|
| 1,882,490 | 10/1932 | Falck | 128/57 |
| 3,606,321 | 9/1971 | Macoulis | 272/142 X |
| 3,874,375 | 4/1975 | Penner | 272/61 X |
| 4,090,706 | 5/1978 | Reda | 272/142 X |
| 4,198,044 | 4/1980 | Holappa | 272/136 X |
| 4,492,373 | 1/1985 | Dzitzer | 272/61 |

FOREIGN PATENT DOCUMENTS

| | | | |
|---|---|---|---|
| 463045 | 7/1928 | Fed. Rep. of Germany | 272/80 |

*Primary Examiner*—Robert A. Hafer
*Assistant Examiner*—Kathleen D'Arrigo
*Attorney, Agent, or Firm*—Michael F. Brown; Ralph R. Barnard

[57] ABSTRACT

A physical therapy device for increasing lumbar spine extension range of motion, comprising a cylindrical rod for elastic material capable of repeated flexing without taking a set or deformation, and having its central patient-contacting portion covered by a cylinder of padding material. The roller thus formed is tethered to a treatment surface by a pair of straps or belts, each having one end attached to the treatment surface and the other attached by means of a snap ring and swivel to a ring carried by a collar on the extremities of the rod. The collars can be moved along the rod and secured where desired, to alter the force potential effective through varying the lever arm, and thus the amount the rod will flex. The ring is located in a portion of the collar having a reduced diameter and is free to rotate with respect to the collar and hence the roller.

10 Claims, 3 Drawing Figures

PHYSICAL THERAPY DEVICE

FIELD OF THE INVENTION

This invention relates to manual or physical therapy devices, and particularly to an improved self mobilization device for increasing lumbar spine extension range of motion.

BACKGROUND OF THE INVENTION

Various types of passive self mobilization devices are already known, the majority of which utilize flat belts of webbing material, akin to automobile seat belts, having an adjustable closure device, as found in the usual adjustable seat belt. Such flat belts do not permit proper concentration of force, and the resistance offered by webbing material is fixed in amount. Another type of such device utilizes a cylindrical pad and attached cords to provide the force, but it does not provide the degree of flexibility, with dimensional stability, which can be obtained with my invention.

OBJECTS OF THE INVENTION

Accordingly, a principal object of my invention is to provide a new and improved self mobilization device for increasing lumbar spine extension range of motion.

Another object of the invention is to provide an improved device of the type described, in which the device can be used on any table, since the attachment belt is adjustable in length.

Another object of the invention is to provide an improved device of the type described which provides greater specificity of force application than is obtainable with known prior art devices of similar nature.

A further object of my invention is to provide an improved device of the type described in which the force application may be easily adjusted.

Yet another object of the invention is to provide an improved device of the type described in which the force application, after having been adjusted to the desired value, retains that setting.

Still another object of the invention is to provide an improved device of the type described in which the assembly is economical in parts and inexpensive to manufacture.

SUMMARY OF THE INVENTION

In accordance with the present invention, there is provided a flexible member, preferably a cylindrical rod, provided with a cushioning outer layer, which is centrally disposed along the length of the rod, leaving the two ends free of the padding or cushioning material. The rod is formed of flexible material, as perfectly elastic as possible, in order that it may be flexed many times but not take on a permanent set, or deformation. One material which I have found to be quite satisfactory is acetal resin, sold by E. I. DuPont DeNemours and Company under the trademark "Delrin". The diameter of the bar may be varied in accordance with the size of the patient and the degree of stiffness required, but the average diameter is one inch. The outer layer of padding may be ordinary pipe insulation, and may also be varied in thickness and resiliency.

Two adjustable collars are provided, one at each end of the rod. These collars may be moved along the rod, and are provided with set screws or other means for fixing them at desired positions along the rod. Alternatively, the collars can be split so that the halves can be slid along the rod to the desired location, and then tightened on the rod.

An annular recess or undercut portion is provided on each of the collars and a ring encircles the collar in the recessed or cut down portion, with a sufficiently loose fit to permit the ring and collar and rod to rotate freely with respect to each other. A belt of suitable webbing material has its ends attached to the rings on the collars by combined clips or snap hooks and swivel joints, to permit wide freedom of attachment with respect to location of the rod on the patient. The belt, which can be either one or two pieces, is attached by any suitable means to the treatment table or surface, or the belt may simply and preferably pass under the table and attach to itself.

BRIEF DESCRIPTION OF THE DRAWINGS

The foregoing objects and other features and advantages of my invention will become more fully understood from the following detained description when considered with the accompanying drawings, in which.

Similar reference characters refer to similar parts in each of the several views.

DETAILED DESCRIPTION OF THE INVENTION

Figure 1:
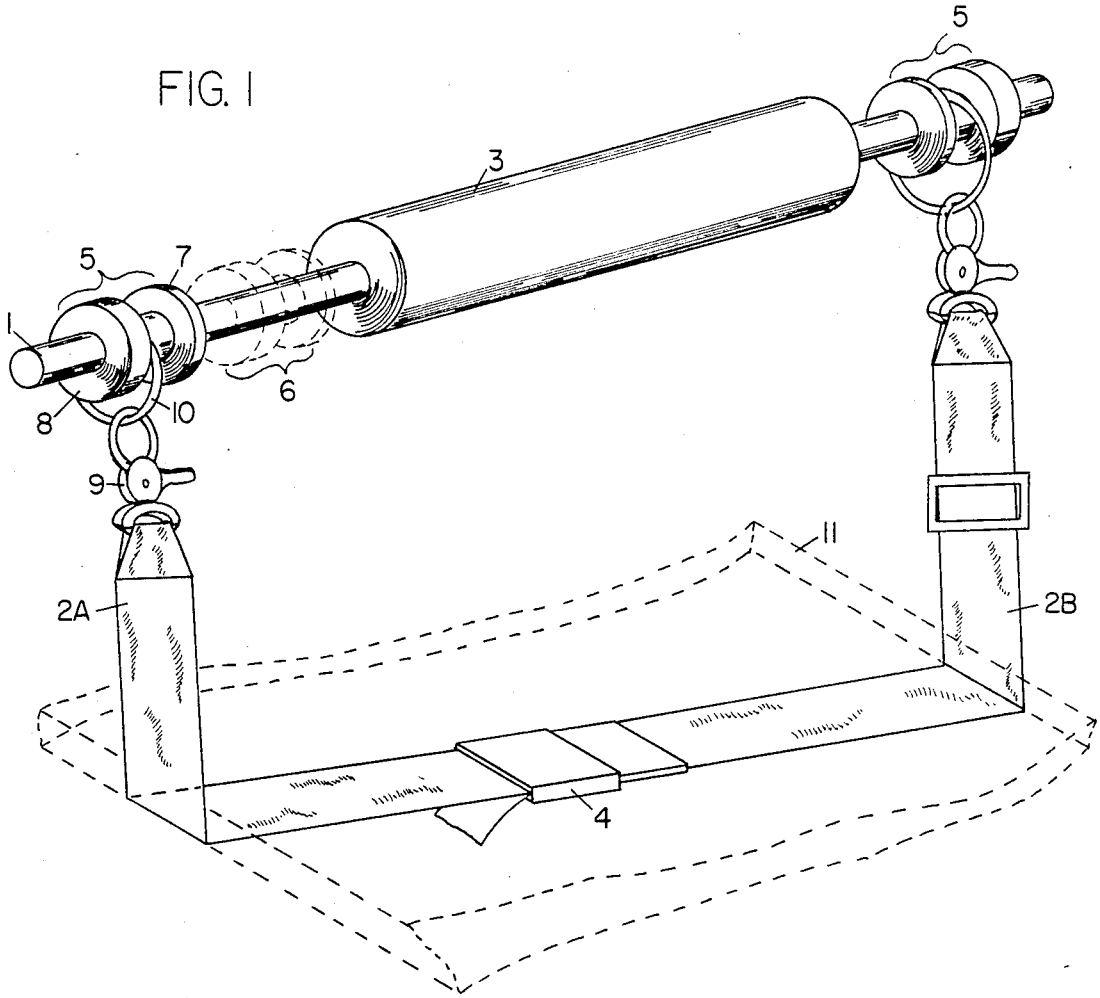
FIG. 1 is a schematic perspective view of a physical therapy device in accordance with one preferred form of my invention.

Referring now to the drawings, FIG. 1 is a schematic perspective view of a physical therapy device arranged in accordance with my invention. A rod or cylindrical bar (1) has mounted on the central portion thereof a cylinder of padding (3). The rod is made of a suitable elastic material capable of repeated bending or flexing without acquiring a permanent set or deformation. One material well suited to this use is acetal resin, also known as polyformaldehyde resin or polyoxymethylene resin, sold by E. I. DuPont DeNemours and Company under the trademark "Delrin".

Rod (1) and cylindrical pad (3) are of dimensions determined by the size of the patient to be treated and the degree of flexibility required. Preferably the diameter of rod (1) would be ¾ inch, which would allow the cylinder (3) to be standard ¾" pipe insulation with an outside diameter of approximately 1½ inch. The amount of padding could be varied, as desired, to vary the specificity of the force applied. The length would be determined principally by the width of the treatment surface such as a conventional treatment table.

On each end of rod (1), there is provided a collar element (5) used to provide an adjustable fixation point along the rod (1). Each of the collars (5) is a sliding fit on rod (1), and each may be moved along the length of the rod to any position between the end of the rod (8) and the end of the cylinder of padding (6). By varying the level arm of the collars along the rod, this allows the amount of force applied to be adjusted to a degree impossible with earlier devices. With the collar elements in position (8), a great deal of leverage exists, and the rod may bend more easily then with the elements in position (6). Thus, the collar elements may be moved inward along the rod until the rod exerts exactly the bending resistance required for a given patient.

Figure 2:
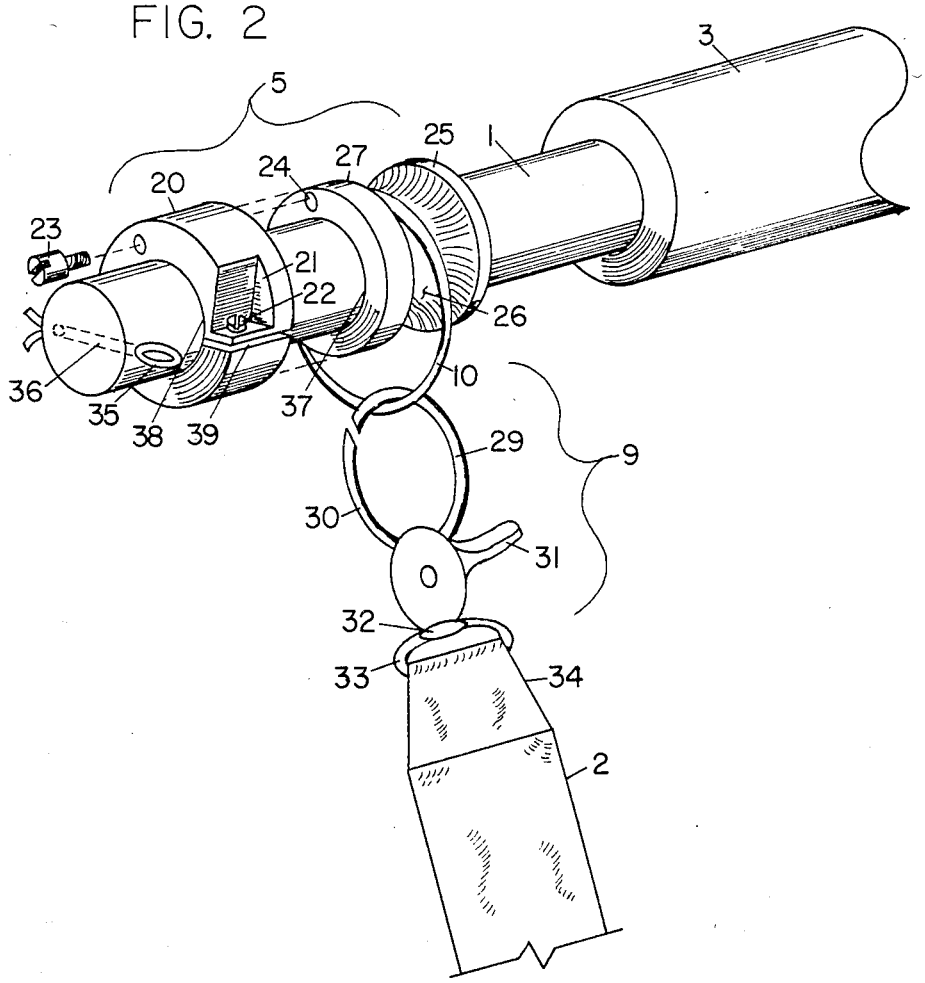
FIG. 2 is an enlarged view of the attachment elements shown in FIG. 1.

FIG. 2 shows details of the collar elements, straps and rod ends as used in the preferred embodiment of the invention. The collar element (5) is made of two parts, a split ring (20) and a flange element having inner (25) and outer (24) flanges and a central "saddle" (26) of smaller diameter. The flange element has an inside bore (37) large enough to allow it to slide freely on the rod (1). The flange element is preferably made of a self-lubricating material such as soft brass or aluminum, to allow a ring (10) to rotate freely in the saddle (26). The inner flange (25) is slightly larger in diameter than the ring, (10) the outer flange (27) is slightly smaller, so that the ring (10) may be slipped onto the saddle (26) over the smaller flange (25). The outer flange (27) has a tapped hole (24) which mates with an attaching screw (23) in the split ring (20), so that the split ring and flange elements may be firmly attached together. The split ring (20) has an outside diameter which is slightly larger than the ring (10), so that the ring (10), when slipped onto the saddle (26) over the outside flange (27), is trapped between the inside flange (25) and the split ring (20). The inside bore (38) of the split ring (20) is slightly larger than the rod, so that the split ring (10) can initially slide freely along the rod to the desired position. A tightening screw (22) located in a notch (21) in the split ring (20) can be tightened, closing the split (39) in the split ring (20). This reduces the diameter of the split ring (20), gripping the rod (1) and holding the split ring (20) and flange element assembly firmly in place.

If desired, the ends of rod (1) may be drilled with a hole (35) adapted to holding a cotter pin (36), or other object. This will serve as a stop to prevent the collar element (5) from slipping off the end of the rod (1).

Figure 3:
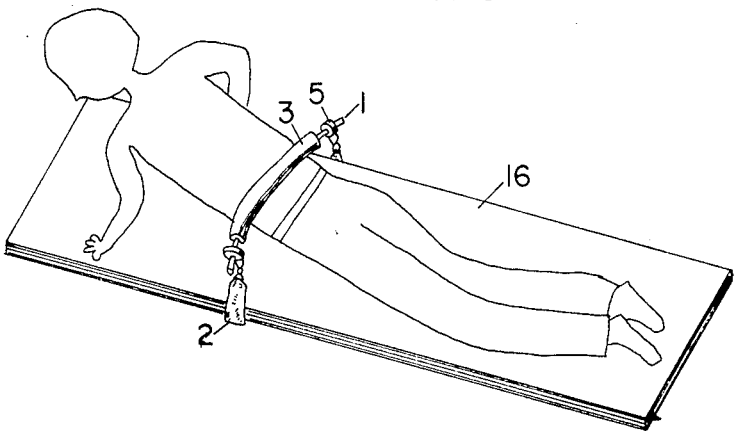
FIG. 3 is a schematic view of the manner of use of the invention.

The rod assembly, described above, is fastened to a strap (2) arrangement, which allows the rod assembly to be attached to a treatment surface or table (11). This may be accomplished by passing the strap (2) under the table (11), as shown in FIG. 1, or by attaching the two halves of the strap (*2a, 2b*) to the surface as shown in FIG. 3. The forming arrangement (FIG. 1) is preferred, as it allows the invention to be used with any table. The strap may be split into halves (*2a, 2b*), as shown, and a buckle (4) provided for ease of use, or a continuous strap could be used, which could be unsnapped at the rings (10). The length of the strap should be adjustable, either at the buckle (4) (FIG. 1), which could be a conventional adjustable seat-belt buckle, or by means of adjusters (40) on one or both straps. The straps may be made of any convenient material having sufficient strength, such as conventional seat-belt webbing.

The ends (9) of the straps (2) are attached to the rings (10) by any conventional means desired. FIG. 2 shows the details of the preferred method of attachment. A conventional "snap hook" arrangement (9) is preferably used, in which a ring (33) is passed through a loop (34) formed in the end of the strap (2). The hook, having two interlocking jaws (29) and (30), and a lever (31) to open the jaws, is preferably attached to ring (33) by a swivel (32) which aids in the ease of use of the invention by allowing the strap (2) to twist relative to the rod (1) without tangling. The jaws of the snap hook grip ring (10), fastening the strap (2) firmly to the rod (1), while still permitting considerable movement of rod and strap.

FIG. 3 is a view of the invention in use. As shown, the patient is in the prone position, on the treatment surface or table (16). The roller, comprising the rod (1) and the padding (3), is positioned for the desired application to the patient's lumbar region. The roller may be rolled into the proper position, due to the design of the collar elements and rings. The force can be adjusted by moving inwardly or outwardly on the rod (1). The patient pushes upwardly against the roller, in a manner similar to the well-known "push-up" exercises. The rod deforms, as shown, to resiliantly resist the force applied by the patient. The use of the present invention permits the practitioner to adjust the potential force to be applied to the patient's lumbar region in accordance with the patient's needs in the most efficacious manner. The actual amount of force applied is determined by the patient himself, in that the invention acts to focus a self-applied force. This self-determination of force is a very important advantage to the use of the invention in therapy. The design of the invention allows the force to be applied repeatedly and comfortably, with the therapist and patient co-operating in the process.

From all of the foregoing, it will be apparent that my invention provides a new and unique physical therapy device, which is easy and economical to manufacture, and which provides an adjustable and reproducible force application to the patient. Further, the ease of attachment and use of the device provides advantages and time and efficiency for the therapist.

Although I have herein shown and described several preferred embodiments of my invention, it will be apparent to those skilled in the art to which it pertains, that various changes and modifications may be made to the subject invention, without departing from the spirit and scope thereof, and therefore it is to be understood that all modifications, variations and equivalents within the spirit and scope of the subject invention are herein meant to be encompassed in the appended claims.

Having thus described my invention, what I claim as new and desire to secure by Letters Patent, is:

1. A physical therapy device, comprising, in combination: a roller, having a length with two end portions and a central portion therebetween, the roller comprising a cylindrical rod of elastic material and a cylindrical layer of padding surrounding the central portion of said rod; tethering means attaching said roller to a treatment surface, and attachment means rotatably attaching said tethering means to said rod at a selected location on each end portion along the length of said rod such that the rod may rotate relative to the tethering means.

2. A physical therapy device as claimed in claim 1, in which said rod is made of acetal resin.

3. A physical therapy device comprising, in combination: a roller, having a length with two end portions and a central portion therebetween, the roller comprising a cylindrical rod of elastic material and a cylindrical layer of padding surrounding the central portion of said rod; tethering means attaching said roller to a treatment surface, and attachment means rotatably attaching said tethering means to said rod at a selected location on each end portion along the length of said rod such that the rod may rotate relative to the tethering means, the attachment means comprising a movable collar on each end portion of said rod, each of said collars having clamping means integral therewith for securing the collars at a selected location on each end portion of said rod.

4. A physical therapy device as claimed in claim 3, in which the collars are provided with set screws for fixing their location on the rod.

5. A physical therapy device as claimed in claim 3, in which the collars are split collars with integral tightening screws for fixing the location of the collars on the rod.

6. A physical therapy device as claimed in claim 3, in which each of the collars is provided with a central section having a smaller diameter than the end sections of the collars, and a ring disposed on said central section, said ring having a diameter larger than the diameter of the central section of said collar and smaller than the diameter of the end section of said collar, whereby the ring fits loosely on said central section of said collar, but cannot slip off the end portions of said collar.

7. A physical therapy device as claimed in claim 6, in which the tethering means comprises two flat straps of webbing material, one for each end of said rod, each of said straps having means at one end thereof for attaching the end of the strap to a treatment surface, and having means at the other end for detachably connecting said ring to said strap.

8. A physical therapy device as claimed in claim 7, in which the means for detachably connecting said ring to said strap comprises a snap hook and swivel combination.

9. A physical therapy device as claimed in claim 7, in which there is provided for each of the straps, buckle means for altering the length of said straps.

10. The physical therapy device of claim 3 in which the rod is made of acetal resin.

* * * * *